US011987927B2

(12) United States Patent
Stewart

(10) Patent No.: US 11,987,927 B2
(45) **Date of Patent: *May 21, 2024**

(54) LAUNDERABLE ACTIVATED COTTON

(71) Applicant: ENERGY OGRE LLC, Houston, TX (US)

(72) Inventor: Graham Ralph Stewart, Mount Pleasant, SC (US)

(73) Assignee: Energy Ogre LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/934,831

(22) Filed: Sep. 23, 2022

(65) Prior Publication Data

US 2023/0018084 A1 Jan. 19, 2023

Related U.S. Application Data

(63) Continuation of application No. 17/582,204, filed on Jan. 24, 2022.

(60) Provisional application No. 63/141,219, filed on Jan. 25, 2021.

(51) Int. Cl.

| | |
|---|---|
| ***D06P 1/00*** | (2006.01) |
| ***D06L 4/13*** | (2017.01) |
| ***D06L 4/40*** | (2017.01) |
| ***D06L 4/70*** | (2017.01) |
| ***D06M 15/263*** | (2006.01) |
| ***D06M 15/643*** | (2006.01) |
| ***D06P 3/60*** | (2006.01) |

(52) U.S. Cl.

CPC ..... *D06P 1/0024* (2013.01); *D06L 4/13* (2017.01); *D06L 4/40* (2017.01); *D06L 4/70* (2017.01); *D06M 15/263* (2013.01); *D06M 15/643* (2013.01); *D06P 3/60* (2013.01)

(58) Field of Classification Search

CPC . D06P 1/0024; D06P 3/60; D06L 4/40; D06L 4/13; D06L 4/70; D06M 15/263; D06M 15/643

See application file for complete search history.

(56) References Cited

U.S. PATENT DOCUMENTS 3,954,652 A * 5/1976 Schmidt ..... D06L 4/30 252/188.23
4,322,214 A * 3/1982 Manabe ..... D06P 1/65181 8/618
4,985,545 A * 1/1991 Himeno ..... C09B 62/5036 552/245
5,700,573 A 12/1997 McCullough
5,763,103 A 6/1998 McCullough
(Continued)

FOREIGN PATENT DOCUMENTS

EP 0252689 B1 * 6/1991
WO WO-2016178662 A1 * 11/2016 ..... A41D 31/08

OTHER PUBLICATIONS

Tzanov, Dyeing With Enzymatically Treated Bleaching Effluents, AATCC Review, Oct. 2001, p. 1-4 (Year: 2001).*
(Continued)

*Primary Examiner* — Tabatha L Penny
(74) *Attorney, Agent, or Firm* — Fish & Richardson P.C.

(57) ABSTRACT

An activated cotton material and a method for processing cotton to form the activated cotton material are provided. The activated cotton material includes a layer of natural wax that is locked to the surface of cotton fibers by a wax lock.

15 Claims, 1 Drawing Sheet

100

(56) References Cited

U.S. PATENT DOCUMENTS

| | | | | |
|---|---|---|---|---|
| 5,776,607 | A | 7/1998 | McCullough | |
| 5,776,609 | A | 7/1998 | McCullough | |
| 6,007,584 | A * | 12/1999 | Suzuki | C11D 1/83 510/357 |
| 2005/0097685 | A1 | 5/2005 | Seuthe et al. | |
| 2005/0266753 | A1* | 12/2005 | Fang | D21H 21/16 442/76 |
| 2006/0042020 | A1* | 3/2006 | Salmon | D06M 16/003 8/115.51 |
| 2015/0233022 | A1 | 8/2015 | McCullough | |
| 2015/0299948 | A1 | 10/2015 | Pan et al. | |
| 2017/0198432 | A1 | 7/2017 | Richards et al. | |
| 2022/0235518 | A1 | 7/2022 | Stewart | |
| 2022/0389650 | A1 | 12/2022 | Stewart | |
| 2023/0018084 | A1 | 1/2023 | Stewart | |

OTHER PUBLICATIONS

Siddiquee, Comparative study of conventional and enzymatic pretreatment (scouring and bleaching) of cotton knitted fabric, International Journal of Engineering and Technology, 3(1), 2014, p. 37-43 (Year: 2014).*

Andleeb et al. "Developing affordable and accessible proangiogenic wound dressings; incorporation of 2 deoxy D-ribose (2dDR) into cotton fibres and wax-coated cotton fibres," Tissue Engineering and Regenerative Medicine, May 2020, 14(7):973-988.

Elwin et al., "Will fashion dye another day" Planet Tracker, Dec. 2020, 58 pages.

International Search Report and Written Opinion in International Appln. No. PCT/US2022/013623, dated Apr. 7, 2022, 11 pages.

Ma et al. "Combinative Scouring, Bleaching, and Cationization Pretreatment of Greiga Knitted Collon Fabrics for Facilely Achieving Salt-Free Reactive Dyeing," Molecules, Dec. 2017, 22(12):14 pages.

Phillips et al., "Influence of different preparation and dyeing processes on the physical strength of the Ingeo fibre component in an Ingeo fibre/cotton blend. Part 2; Bleaching followed by dyeing with disperse and reactive dyes," Coloration Technology, Jun. 2006, 120(1):41-45.

TashaMillerGriffith.com [online], "Natural dye basics & mythbusting part 1: introduction & scouring," May 2019, retrieved on Jul. 15, 2022, retrieved from <https://tashamillergriffith.com/2019/05/12/natural-dye-basics-1-scouring/>, 14 pages.

International Preliminary Report on Patentability in International Appln. No. PCT/US2022/013623, mailed on Jul. 20, 2023, 9 pages.

Zhou et al., "An eco-friendly approach to low-temperature and near-neutral bleaching of cotton knitted fabrics using glycerol triacetate as an activator," Cellulose, Aug. 2021, 28(12):8129-38.

International Search Report and Written Opinion in International Appln. No. PCT/US2023/030780, mailed on Jan. 25, 2024, 10 pages.

* cited by examiner

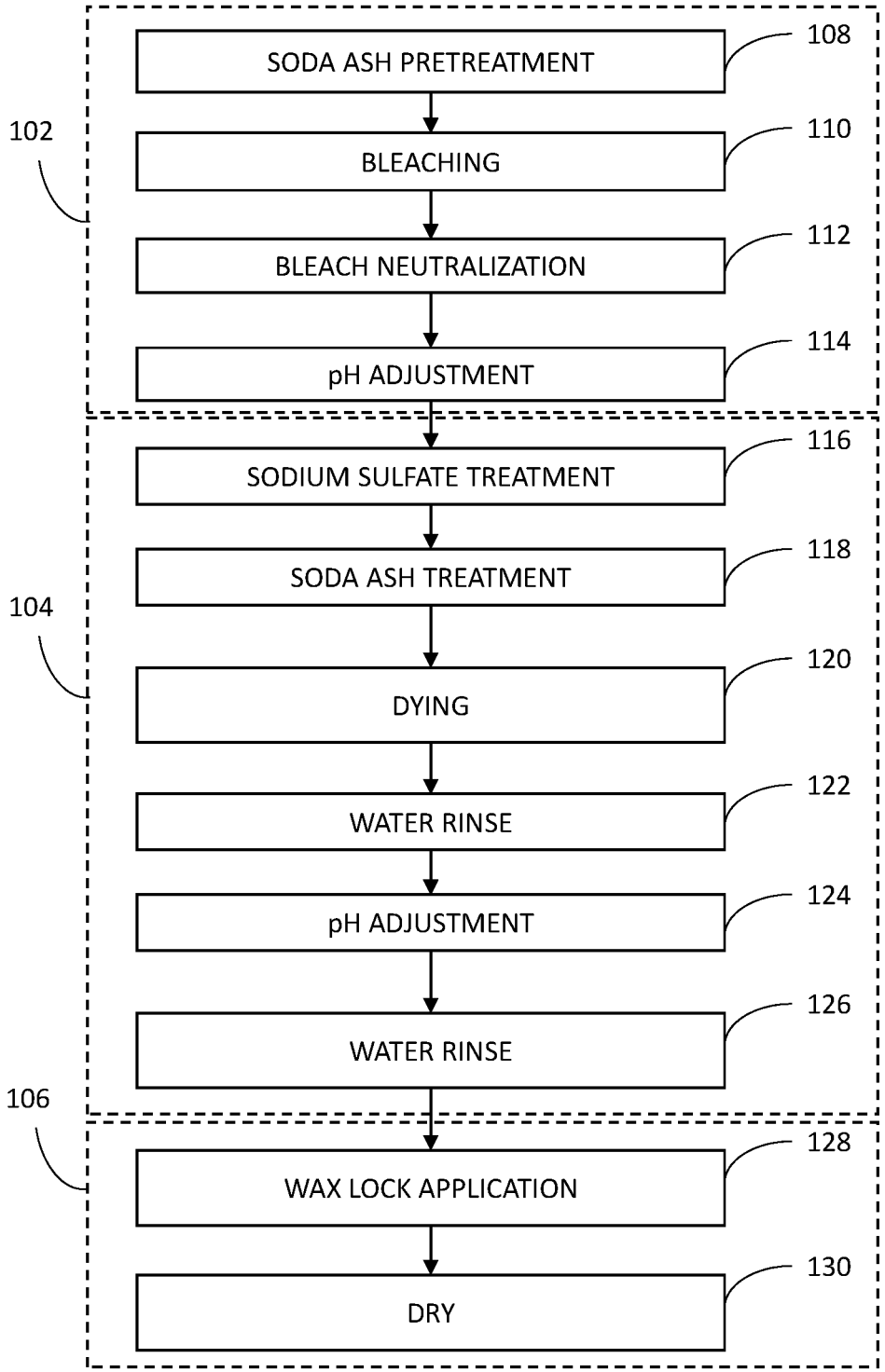
100

LAUNDERABLE ACTIVATED COTTON

CLAIM OF PRIORITY

This application claims priority under 35 USC § 120 to U.S. patent application Ser. No. 17/582,204, filed on Jan. 24, 2022 titled: "Launderable Activated Cotton"; which claims priority under 35 USC § 119(e) to U.S. Provisional Patent Application Ser. No. 63/141,219, filed on Jan. 25, 2021 titled: "Activated Cotton Fabric and Related Methods"; the entire contents of which are hereby incorporated by reference.

TECHNICAL FIELD

The present disclosure is directed to a process for increasing the strength and decreasing the wettability of cotton materials.

BACKGROUND

Cotton is a natural fiber with a negative environmental impact when processed. Currently, the fiber is bleached, finished with strong alkali to prepare for a dying process, and dyed. The strong alkali has to be neutralized at each stage of production in particular to mitigate the damaging effluent that would otherwise be released into the worlds aqueous eco systems.

A substantial amount of water waste is generated by repeatedly washing off the alkali involved in wet processing. For example, a report in the Planet Tracker, "Will Fashion Dye Another Day" (December 2020), notes that "textile production requires an estimated 430 liters or 114 US gallons to produce 1 kg of textile fabric." The report continues, stating that an estimated 8,000 toxic chemicals, used globally, are used to turn raw materials into textiles. Many of these chemicals are released into freshwater sources as waste streams. For example, "the dyeing and treatment of textiles is estimated to cause 20% of global industrial water pollution."

Cotton is at the top end of this estimate, requiring more water to process than polyester, viscose rayon, and wool. Thus, it is likely that the production and dying of cotton fabric is a significant contributor.

Further, the current processing techniques used for cotton are energy intensive, requiring multiple drying cycles. Reducing the heat used in dyeing and shortening the dye cycles will lower the energy demand.

SUMMARY

An embodiment described in examples herein provides a method for treating cotton. The method includes treating the cotton with soda ash at a temperature of less than about 150° F. (about 66° C.) and a pH of about 9.5, bleaching the cotton with hydrogen peroxide at a temperature of less than about 150° F. (about 66° C.), and neutralizing the hydrogen peroxide. The pH is lowered with an organic acid to between about 6 and about 7, and the cotton is dyed at a temperature of less than about 150° F. (about 66° C.). The cotton is treated with a wax lock compound.

Another embodiment described herein provides an activated cotton material, including a layer of natural wax locked to the surface of cotton fibers by a wax lock.

BRIEF DESCRIPTION OF DRAWINGS

FIG. 1 is a process flow diagram of a method for treating and dying cotton fabric.

DETAILED DESCRIPTION

The industry standard technique for treating cotton for dying is termed Kiering. Kiering is generally performed on cotton fabric or yarn to prepare it for dyeing. It uses a scouring process in which hot alkali (NaOH) solutions are used to saponify the natural wax coating on the cotton fibers, removing the wax. This increases the absorbency (hydrophilicity) of the cotton fabric, making the fabric easier to dye. However, multiple rinses of water are required to remove the alkali solutions. Further, the alkali softens the fabric by partially breaking down the fibers, leading to a lower strength product.

After the scouring, the cotton is bleached to remove color bodies, forming a white material. The bleaching can be performed by the use of hydrogen peroxide or other bleaches, such as hypochlorite bleach, among others.

The treated cotton can then be dyed, for example, as yarns or fabric, depending on the products. In the dying process, the cotton may be passed through, or soaked in, baths that include chemicals that help the dye to adhere to the cotton, for example, by forming hydroxyl groups at the surface of the cotton. The cotton is then passed through, or soaked in, a bath containing the dye. This is often followed by multiple rinses to remove any excess dye that does not adhere to the cloth.

If the treating and dying process is performed on a cotton yarn, the yarn is then formed into a fabric, for example, by knitting or weaving. The currently used techniques for treating cotton form an absorbent fabric with a color selected by the techniques used. However, the alkali treatment reduced the strength of the cotton fibers, for example, by as much as 50% or more, from the raw cotton.

A process is provided herein for producing a cotton product, termed an activated cotton, which leaves the natural wax in place on the cotton fibers, lowers water usage, and improves the properties of the cotton. The natural wax coating on the cotton fibers imparts high performance properties to yarns and fabrics, for example, increasing the cooling properties of the fabric by allowing water vapor to pass through the fabric without being adsorbed. To implement this, the process includes the addition of a compound termed a wax lock.

As described, the wax coating on natural cotton is generally removed during Kiering. Further, even if left on by a milder process, home laundering will remove the natural wax in very few cycles. To overcome this, the activated cotton is treated with the wax lock to fix the wax in place on the fabric. In some embodiments, the wax lock includes a silicone compound that interacts with the natural wax to prevent surfactants from removing the wax.

In other embodiments, the wax lock is a cross-linking agent, such as a synthetic acrylic oligomer, that is applied before the final drying process and activated during drying. The cross-linking agent forms cross-links that hold the natural wax in place on the fibers. This makes the cotton fabric hydrophobic and enables it maintain the hydrophobicity during numerous home laundering cycles, for example, greater than 20 cycles, greater than 25 cycles, greater than 30 cycles, or longer.

In the process, the bleaching is performed using hydrogen peroxide. A peroxide activator, triacetin, is used along with a sequestering agent to protect the cotton fiber and the natural wax. The triacetin gradually lowers the pH, creating conditions for the peroxide to be a highly effective bleaching agent to prepare the cotton for dying. This allows the elimination of the strong caustic alkali used in used in traditional bleaching and dye preparation methods. This also creates conditions for an enzyme bleach catalyst to be effective.

The process changes and combinations described herein shorten the process further and increase water savings. This provides a more stable, repeatable, and ecologically favorable process. Further, the natural wax coating on the cotton will withstand 30 or more home laundering cycles with a surfactant, such as laundry detergent.

FIG. 1 is a process flow diagram of a method 100 for activating cotton. As described herein, the process may be used on cotton at any number of points in the production of a cotton product, including, for example, on cotton slivers, yarn, or fabric, among others. An example of the process is described in the examples section below. It should be noted that the individual steps may be rearranged, eliminated, or modified. For example, in some embodiments, the soda ash pretreatment may be eliminated. It should also be noted that no surfactants are used in the process to avoid removing the natural wax coating.

The method 100 includes three basic processes, a pretreatment process 102 used to clean the cotton and bleach it to remove color bodies and prepare the cotton for dying. A dying process 104 is used to impart color to the cotton. A finishing process 106 is then used to apply the wax lock to lock the natural wax coating on the cotton fibers, allowing multiple home launderings without removing the wax coating. The pretreatment process 102 begins at block 108 with a soda ash pretreatment. The use of soda ash, $Na_2CO_3$, is in place of caustic soda (NaOH) used in the standard Kiering process. The use of NaOH sets the pH at 12.5, which damages the cotton fibers and removes the natural wax by saponification. The soda ash sets the pH of the treatment, for example, to about 10, or about 9.5. The lower pH prevents, or decreases, the likelihood of saponification of the wax coating. Further, this is performed at a lower temperature than previous pretreatment procedures, for example, about 150° F. (66° C.).

During the soda ash pretreatment at block 108, a bleach activator, for example, glyceryl triacetate (triacetin), is added for activation of hydrogen peroxide in the subsequent bleaching procedure. The triacetin is available from Cekal Specialties of Mt. Holly, NC, USA, under the tradename CEKASSIST BIO. Further, a sequestering agent, such as ethylenediaminetetraacetic acid (EDTA), is used to lower the concentration of divalent metal ions, such as magnesium (II) and calcium (II). In an embodiment, the sequestering agent is CEKAQUEST PB from Cekal Specialties, which is also helping stabilize the hydrogen peroxide bleach. The decreasing concentration of the divalent metal ions will further stabilize the hydrogen peroxide during the bleaching procedure.

At block 110, a bleaching procedure is performed using a 50% solution of hydrogen peroxide. During the bleaching procedure, an arylesterase catalyst is added to speed the reaction between the peroxide and the color bodies. Generally, the arylesterase catalyst is produced by microorganisms, for example, in a commercial production process. Any number of arylesterase catalysts can be used in the current procedures. In an embodiment, the arylesterase catalyst is obtained from Cekal Specialties under the tradename CEKAZYME BB.

At block 112, the peroxide bleach is neutralized by the addition of a catalase enzyme. Any number of catalase enzymes may be used in the current procedures. In an embodiment, the catalase is CEKAZYME EPK200 from Cekal Specialties. In some embodiments, a test strip is used to confirm that the peroxide is eliminated. If not, in some embodiments, a water wash is used to rinse any remaining peroxide from the cotton.

At block 114, the pH is lowered to a pH of less than about 8, less than about 7, or between 6.5 and 7. In some embodiments, this is performed by the addition of an organic acid, such as citric acid, acetic acid, or others. In some embodiments, the pH is checked to confirm that it is between 6.5 and 7. If not, more acid may be added, and the pH retested.

A surface tension test may be used to confirm that the pretreatment process 102 did not damage or remove the natural wax coating. In some embodiments, the surface tension test is performed by placing a drop of water on the cotton, such as a fabric surface, and noting if the water beads or is absorbed. In other embodiments, a goniometer is used to determine the surface tension of the surface, which may be used to determine the efficacy of the treatment.

The dyeing process 104 begins at block 116, with the treatment of the cotton with sodium sulfate. At block 118, Na2CO3 is added to raise the pH to about 9.5, or about 10. The pH may be checked, and more Na2CO3 added if needed to adjust the pH to 9.5. The use of the weak alkali helps retain and protect the cotton wax and the cotton cellulose. It is used in place of the caustic soda (NaOH) used in the standard Kiering procedure, which would set the pH at 12.5, damaging the cotton and removing the natural wax via saponification.

At block 120, the dying compound is added to the solution. In some embodiments, the dye is a reactive dye, although any number of other types of dyes may be used, including direct dyes, sulfur dyes, azoic dyes, or vat dyes, among others. The dye liquor is heated to a maximum temperature of about 140° F. (about 60° C.) at a rate of about 2° F./min (about 1.1° C./min.). The dye is allowed to stay in contact with the cotton for a sufficient period of time for absorbance, for example, 30 min., 45 min., 60 min., or longer.

At block 122, the dye and salts are rinsed from the solution. At block 124, the pH is lowered to less than 8, or less than 7, or about 6.5. This is performed by the addition of an organic acid, such as citric acid, acetic acid, or the like. At block 126, a water rinse is performed to remove the acid and any remaining dyes or salts. In some embodiments, the pH is checked to confirm that it is between 6.5 and 7. If not, more acid may be added, and the pH retested.

The finishing process 106 begins at block 128 with the application of the wax lock. As described herein, the wax lock locks the natural wax to the cotton fibers, slowing its removal by laundering. The wax lock may include silicone compounds, acrylic oligomers, or combinations. Other materials may be used, such as other types of oligomers or monomers. The silicone wax lock compound used in some embodiments is available from Apexical Specialty Chemicals of Spartanburg, SC, USA, as Apexosil 2137. In some embodiments, a small amount of acrylic monomers or oligomers may be included, such as about 1 wt. %, about 2 wt. %, about 5 wt. %, about 10 wt. %, about 20 wt. %, or higher.

In some embodiments, the wax lock is a blend that includes an acrylic oligomer, such as available from Cekal Specialties as CEKAPEL NFWR. In this example, the acrylic polymer blend includes 20-30 wt. % of a liquid, crosslinking acrylic polymer. The blend also includes 5-10 wt. % of dipropylene glycol. The dipropylene glycol lowers the viscosity of the polymer blend, improving the uptake into the cotton.

Similar materials are available from other suppliers. These include blends in the Hycar line from Lubrizol, Corp. of Wickliffe, OH, USA. Other materials are available from Apexical Specialty Chemicals, Huntsman Chemicals of Charlotte, NC, USA, and Chemours of Wilmington, DE, USA.

In some embodiments, the wax lock compound is a blend that includes natural plant material isolated from plant wastes, for example, the by-products that accumulate during the processing of cereal grains in the food industry. A crosslinker may be included in the blend to assist in locking the natural wax and the natural plant material to the fibers of the cotton. The natural plant material is available from Rudolf GmbH of Geresreid, DE, as RUCO®-DRY BIO CGR. The crosslinker is available from Rudolf as RUCO®-LINK XHC.

At block 130, the cotton is dried to fix the wax lock compound. In various embodiments, this is performed at a temperature of less than about 400° F. (about 204° C.), or less than about 390° F. (about 199° C.), or less than about 350° F. (about 177° C.), or less than about 310° F. (about 154° C.), or between about 300° F. (about 149°) and about 390° F. (about 199° C.), for example, on a frame or moving line at a speed of about 25 to about 30 yds./min (or about 23 to about 27 meters/min).

It can be noted that all of the enzymes described herein are available from other suppliers. For example, AB Enzymes of Darmstadt, DE, produces analogous arylesterase catalysts and catalase enzymes that may be used in the processes described herein.

EXAMPLES

The treatment process described herein, for example, with respect to FIG. 1, was tested on cotton fabric using the parameters described in Table 1.

The cotton fabric prepared using this technique with a silicone softener as the wax lock compound retained the natural wax through greater than 25 laundering cycles using a cool wash cycle, 1 g/L Tide laundry detergent, and a cool dry cycle. This was tested by performed a surface tension test after each laundering cycle by applying a water droplet and determining that it beaded on the cotton fabric.

TABLE 1

Parameters for treating process applied to cotton fabric

| PRETREATING STAGE | DOSE | PRODUCT/ ACTION | DWELL TIME (MIN) | TEMP. in ° F. (in ° C.) | PROCESS | NOTES |
|---|---|---|---|---|---|---|
| 1 | 2 g/l | Soda Ash ($Na_2CO_3$)<br>3 g/l Triacetin<br>0.5 g/l Sequestering agent | 30 | 150 (66) | Dwell | |
| 2 | 5.0 g/l | Hydrogen Peroxide (H2O2, 50 vol. %) | 10 | 150 (66) | Dwell | Check pH 9.5-10 |
| | | 0.2 g/l Arylesterase catalyst | 10 | 150 (66) | Dwell | |
| 3 | 0.5 g/l | Catalase Enzyme | 15 | 120 (49) | Dwell | Check Peroxide Eliminated |
| 4 | 0.32 g/l | Citric Acid | 12 | | Dwell | Check pH 6.5-7 |
| | | Water-Only Wash | | 120 (49) | | Optional, if peroxide is not eliminated |
| | | Surface Tension Test for Wax | | | | Water beading on surface |

| DYEING STAGE | DOSE | PRODUCT/ ACTION | DWELL (MIN) | TEMP. in ° F. (in ° C.) | PROCESS | NOTES |
|---|---|---|---|---|---|---|
| 1 | 30 g/l | Sodium Sulfate | 10 | 100 (38) | Treat | 10-15 Min |
| 1A | 6 g/l | Soda Ash Dense | 10 | 100 (38) | Treat | |
| 1B | | Add Reactive Dye | 10 | 100 (38) | | |
| 2 | | Heat Dye Liquor | 20 | 140 (60) | Heat | 3° F./min to 140° F. Max Temp. |
| 3 | | Run 45 Mins | 45 | 140 (60) | Dwell | 140° F. Max Temp. |
| 4 | | Water Rinse | 10 | 120 (49) | Dwell | |
| 5 | 0.625 g/l | Citric Acid | 12 | 120 (49) | Dwell | |
| 6 | | Water Rinse | 8 | 120 (49)-140 (60) | Dwell | 140° F. (60° C.) Max Temp. |

| WAXLOCK STAGE | DOSE | PRODUCT/ ACTION | DWELL (MIN) | TEMP. in ° F. (in ° C.) | PROCESS | NOTES |
|---|---|---|---|---|---|---|
| 1 | 3-10% OWB | Wax lock | | | Treat | Wax lock (silicone, acrylic, natural product) |
| 2 | | Fixing wax lock | | 300 (149)-390 (199) | Dry | 25-30 Yds/Min (23-27 m/min.) On Frame |

The burst strength of the cotton fabric was compared to a sample of cotton fabric that was treated by the normal caustic wash. The test performed to determine the strength was the Mullen diaphragm burst test, following ASTM D3787. The strength retained by the cotton fibers depended on the initial lengths of the cotton fibers, e.g., the quality of the cotton. A sample of fabric made using a high quality cotton and treated using the procedure described with respect to FIG. 1 provided an average burst strength of about 210 psi (about 1448 kPa), versus a sample of the same fabric treated with the standard Kiering procedure, which had an average burst strength of about 110 psi (about 758 kPa).

A sample of fabric prepared from a lower quality cotton, e.g., with shorter fiber lengths, still maintained a significant strength advantage when treated with the procedure of FIG. 1 versus the normal Kiering procedure. The fabric prepared from the lower quality cotton that was treated with the standard Kiering procedure had an average burst strength of about 93.9 psi (647 kPa). A sample of the same fabric treated with the procedure of FIG. 1 had an average burst strength of about 109.8 psi (757 kPa).

Embodiments

An embodiment described in examples herein provides a method for treating cotton. The method includes treating the cotton with soda ash at a temperature of less than about 150° F. (about 66° C.) and a pH of about 9.5, bleaching the cotton with hydrogen peroxide at a temperature of less than about 150° F. (about 66° C.), and neutralizing the hydrogen peroxide. The pH is lowered with an organic acid to between about 6 and about 7, and the cotton is dyed at a temperature of less than about 150° F. (about 66° C.). The cotton is treated with a wax lock compound.

In an aspect, the method includes treating cotton fabric. In an aspect, the method includes treating cotton yarn.

In an aspect, the method includes adding a bleach activator with the soda ash. In an aspect, the method includes adding a sequestering agent with the soda ash.

In an aspect, the method includes adding an arylesterase catalyst with the hydrogen peroxide.

In an aspect, neutralizing includes adding an enzyme to degrade the hydrogen peroxide.

In an aspect, the organic acid includes citric acid.

In an aspect, the dyeing includes treating the cotton with sodium sulfate, treating the cotton with soda ash to raise the pH to about 9.5, treating the cotton with a dye solution, and rinsing the cotton. The dye solution is neutralized to a pH of about 6.5; and the cotton is rinsed.

In an aspect, the method includes treating the cotton with the wax lock. In an aspect, the method includes drying the cotton at between about 300° F. (about 149° C.) and 390° F. (about 199° C.). In an aspect, the wax lock includes a silicone compound. In an aspect, the method includes wax lock includes an acrylic compound.

Another embodiment described herein provides an activated cotton material, including a layer of natural wax locked to the surface of cotton fibers by a wax lock.

In an aspect, the activated cotton material includes a dye.

In an aspect, the wax lock includes a silicone compound. In an aspect, the wax lock includes an acrylic oligomer. In an aspect, the wax lock includes a natural plant material.

In an aspect, the activated cotton material includes cotton fabric. In an aspect, the activated cotton material includes cotton yarn.

Other implementations are also within the scope of the following claims.

What is claimed is:

1. A method for treating cotton, comprising, without using surfactants:

treating the cotton with soda ash at a temperature of less than about 150° F. (about 66° C.) and a pH of about 9.5;

adding glyceryl triacetate to the soda ash and cotton;

bleaching the cotton with hydrogen peroxide and arylesterase at a temperature of less than about 150° F. (about 66° C.);

neutralizing the hydrogen peroxide; and lowering the pH with an acid to between about 6 and about 7, wherein the cotton retains a burst strength of 15.9% higher than a cotton sample treated using an NaOH solution at a pH of 12.5.

2. The method of claim 1, comprising treating cotton fabric.

3. The method of claim 1, comprising treating cotton yarn.

4. The method of claim 1, comprising adding a sequestering agent with the soda ash, wherein the sequestering agent comprises ethylenediaminetetraacetic acid (EDTA).

5. The method of claim 1, wherein neutralizing comprises adding an enzyme to degrade the hydrogen peroxide.

6. The method of claim 5, wherein the enzyme comprises a catalase.

7. The method of claim 5, comprising testing if the hydrogen peroxide is neutralized.

8. The method of claim 1, wherein the acid comprises citric acid.

9. The method of claim 1, comprising testing the surface tension of a drop of water placed on the cotton.

10. The method of claim 1, comprising dying the cotton at a temperature of less than about 150° F. (about 66° C.).

11. The method of claim 10, wherein the dying comprises:

treating the cotton with sodium sulfate;

treating the cotton with soda ash to raise the pH to about 9.5;

treating the cotton with a dye solution;

rinsing the cotton;

neutralizing the dye solution to a pH of about 6.5; and rinsing the cotton.

12. The method of claim 1, comprising treating the cotton with a wax lock.

13. The method of claim 12, comprising drying the cotton at between about 300° F. (about 149° C.) and about 390° F. (about 199° C.).

14. The method of claim 12, wherein the wax lock comprises a silicone compound.

15. The method of claim 12, wherein the wax lock comprises an acrylic compound.

* * * * *